United States Patent [19]

Firey

[11] Patent Number: 4,533,362

[45] Date of Patent: Aug. 6, 1985

[54] CYCLIC CHAR GASIFIER WITH PRODUCT GAS DIVIDER

[76] Inventor: Joseph C. Firey, P.O. Box 15514, Seattle, Wash. 98115-0514

[21] Appl. No.: 628,150

[22] Filed: Jul. 5, 1984

[51] Int. Cl.[3] ..... C10J 3/04; C10J 3/22; C10J 3/30; C10J 3/82

[52] U.S. Cl. ..... 48/61; 48/63; 48/77; 48/86 R; 48/87; 48/DIG. 6; 60/39.12; 166/75.1

[58] Field of Search ..... 48/61, 63, 64, 76, 86 R, 48/87, DIG. 6, 210, 77; 60/39.04, 39.12, 39.17; 44/1 F, 2; 166/75 R, 305 R

[56] References Cited

U.S. PATENT DOCUMENTS 1,913,395 6/1933 Karrick ..... 48/DIG. 6
4,085,578 4/1978 Kydd ..... 60/39.12

*Primary Examiner*—Peter Kratz

[57] ABSTRACT

A cyclic char gasifier plant is described which, from a single gas expander, can produce two or more separated and differing product reacted gases by use of an exhaust divider valve at the expander discharge.

11 Claims, 12 Drawing Figures

CYCLIC CHAR GASIFIER WITH PRODUCT GAS DIVIDER

CROSS REFERENCES TO RELATED APPLICATIONS

This application is related to my earlier filed U.S. patent application entitled, "Additionally Improved Cyclic Char Gasifier," Ser. No. 06/552,398, filing date Nov. 16, 1983, and also to my several U.S. patent applications cross referenced therein. This related application, Ser. No. 06/552,398, is hereinafter referred to as referenced application A, and appreciable portions thereof are incorporated herein by reference thereto.

This application is additionally related to my following U.S. patent applications:

1. "Cyclic Velox Boiler," Ser. No. 06/546,093, filing date Oct. 27, 1983, now U.S. Pat. No. 4,455,837; and the divisional application therefrom of the same title, Ser. No. 06/579,562, filing date Feb. 13, 1984, now U.S. Pat. No. 4,484,531.
2. "Cyclic Gas Separator," Ser. No. 06/600,841, filing date Apr. 16, 1984.
3. "Multipressure Compressor," Ser. No. 06/411,913, filing date Aug. 26, 1982, now U.S. Pat. No. 4,480,654, Group Art Unit 343.

BACKGROUND OF THE INVENTION

1. Field of the Invention

This invention is in the field of coal gasifier processes and apparatus, and particularly apparatus capable of carrying out these processes by means of cyclic compression and expansion of reactant gases into and reacted gases out of the pores of the coal or other char fuel so that two or more differing product reacted gases can be formed.

2. Description of the Prior Art

The prior art description for this invention is essentially the same as the prior art already described in my earlier cross referenced application A, and this prior art material and references are incorporated herein by reference thereto.

SUMMARY OF THE INVENTION

A cyclic char gasifier plant of this invention can create two or more separated and differing product gases from a single separate expander by use of an exhaust divider valve connected between the expander discharge and the several product gas collector pipes. The exhaust divider valve is so driven and controlled as to direct one portion of product reacted gas leaving each container into one product gas collector pipe and to similarly direct other portions into other product gas collector pipes during each time interval between changes of container connections to expanders and compressors. Previous cyclic char gasifier plants required a number of separate expanders equal to the number of separated product gases produced. By thus reducing the number of separate expanders required, the use of this invention reduces plant cost and this is a principal beneficial object of this invention.

BRIEF DESCRIPTION OF THE DRAWINGS

The drawings herein are numbered sequentially after the last drawing number from the referenced application A, incorporated herein by reference, in order to avoid confusion of drawing numbers.

Also, the element identifying numbers on the drawings herein are similarly numbered sequentially after the last element identifying number used for referenced application A for the same reason.

Figure 18:
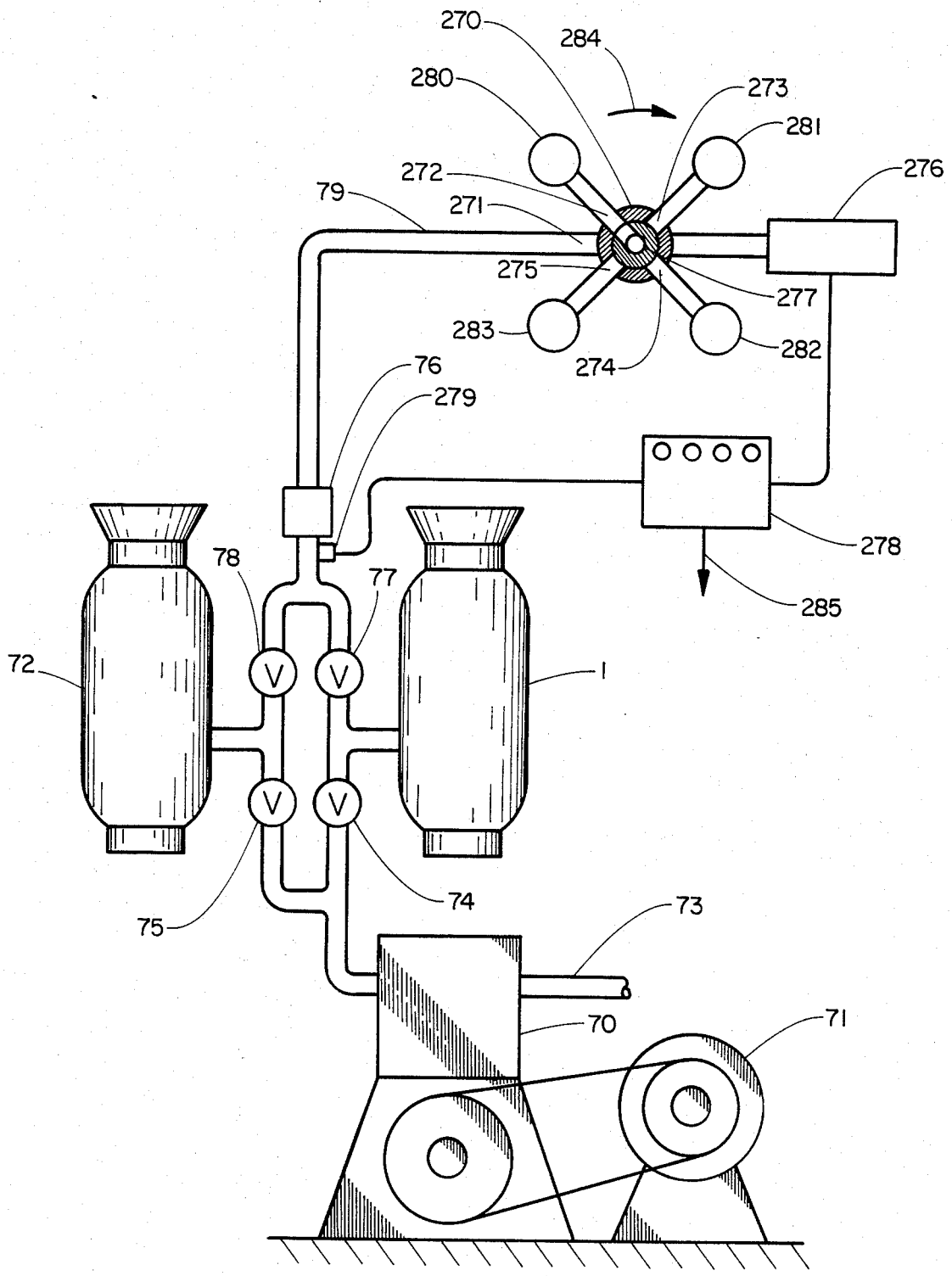

A simple cyclic char gasifier plant with a single expander and equipped with an exhaust divider valve is shown schematically in FIG. 18.

Figure 19:
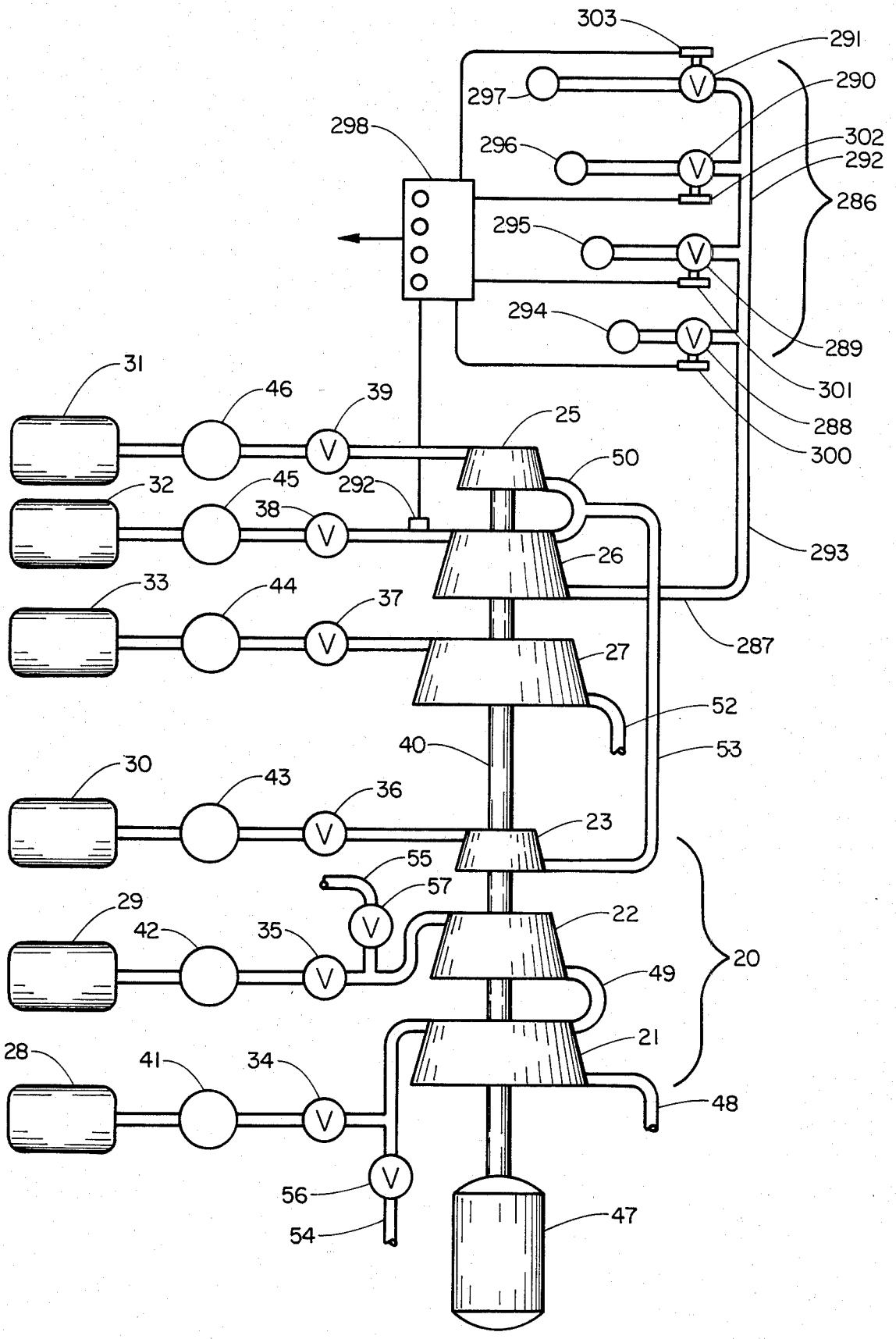

A cyclic char gasifier plant using multistage compression, multistage expansion, two separate expanders, one of which is equipped with an exhaust divider valve at discharge, is shown schematically in FIG. 19.

Figure 20:
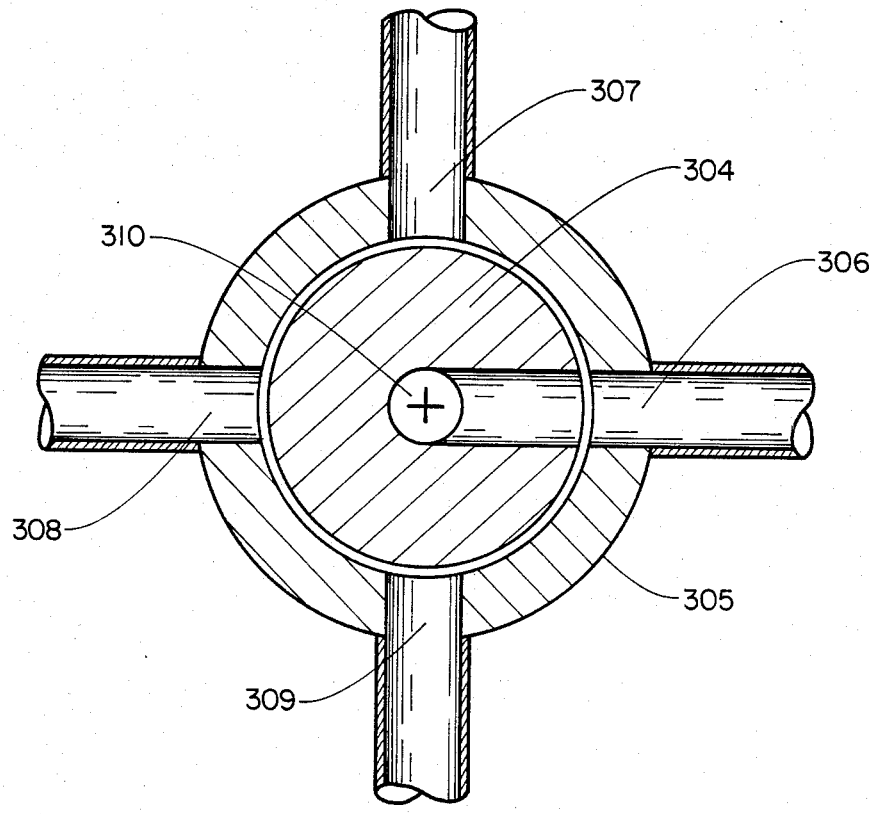

A rotary type of exhaust divider valve is shown in cross section in FIG. 20.

Figure 21:
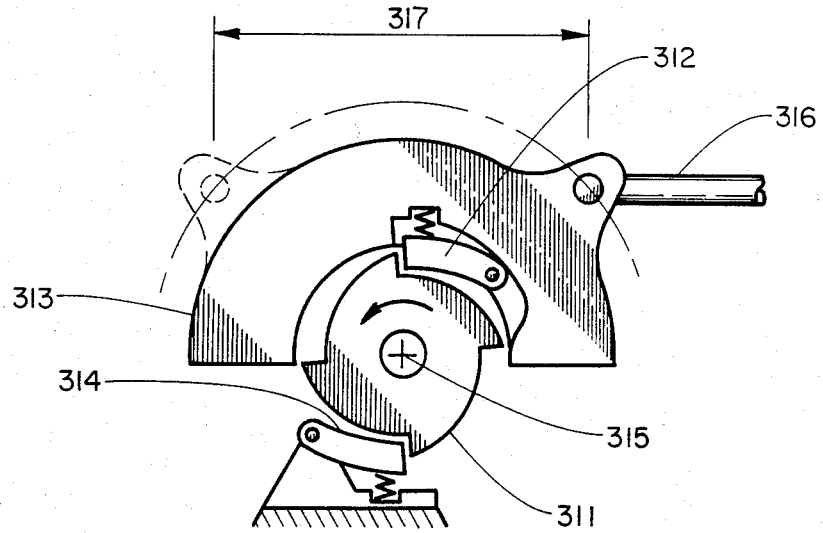
Figure 23:
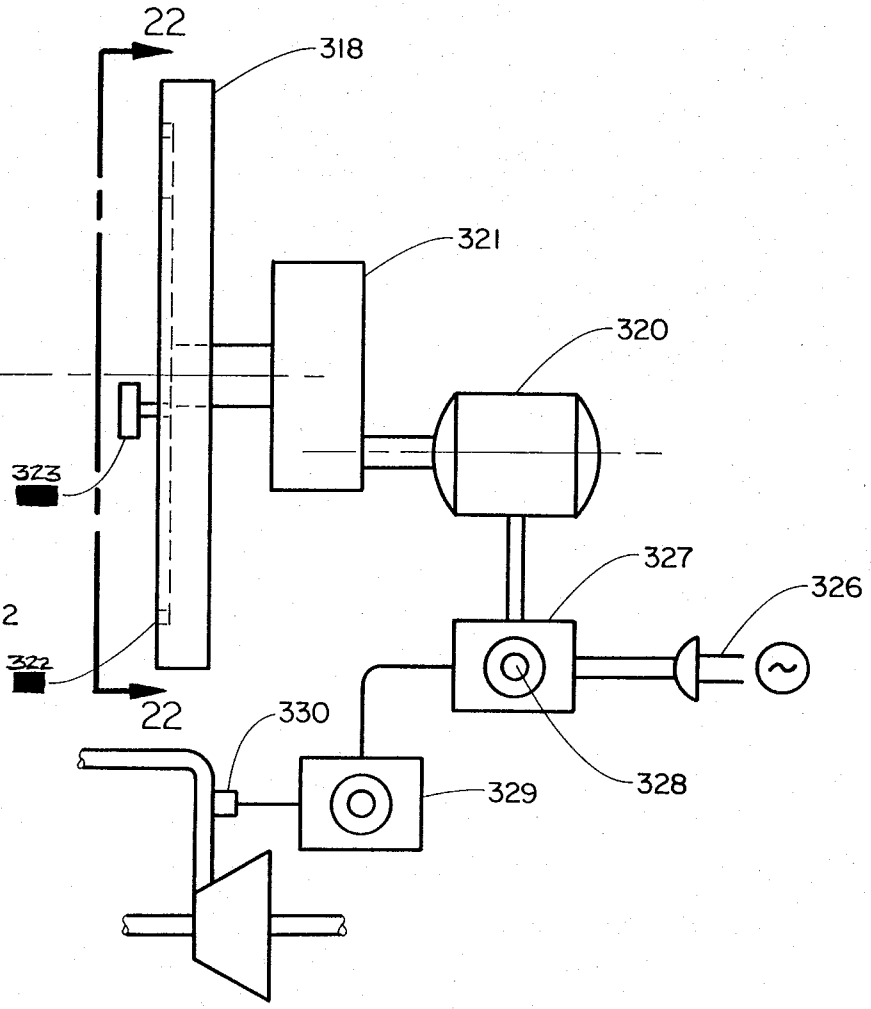
Figure 22:
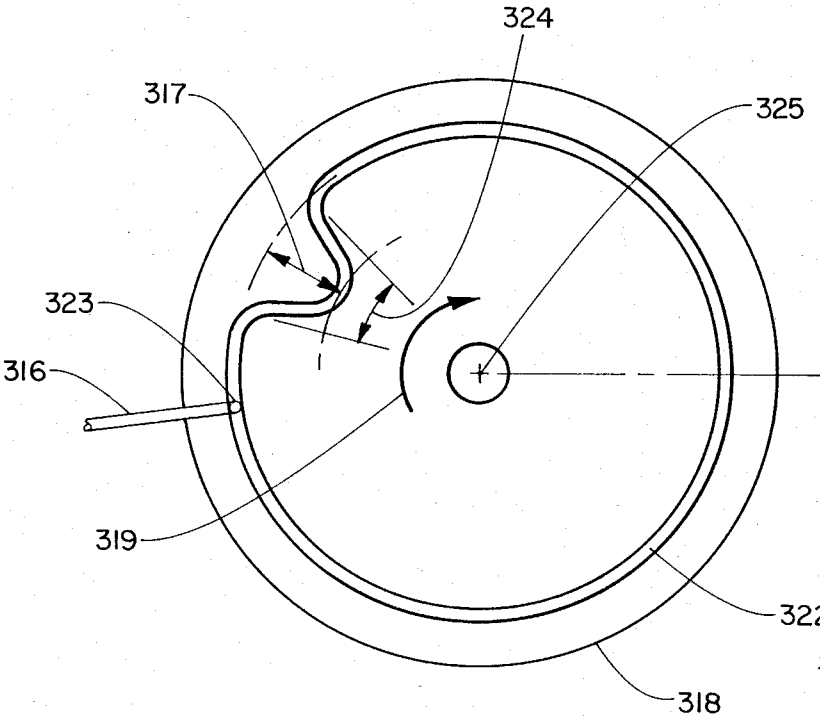

A drive means and control means suitable for use with the exhaust divider valve of FIG. 20 is shown schematically in FIGS. 21, 22, and 23.

Figure 25:
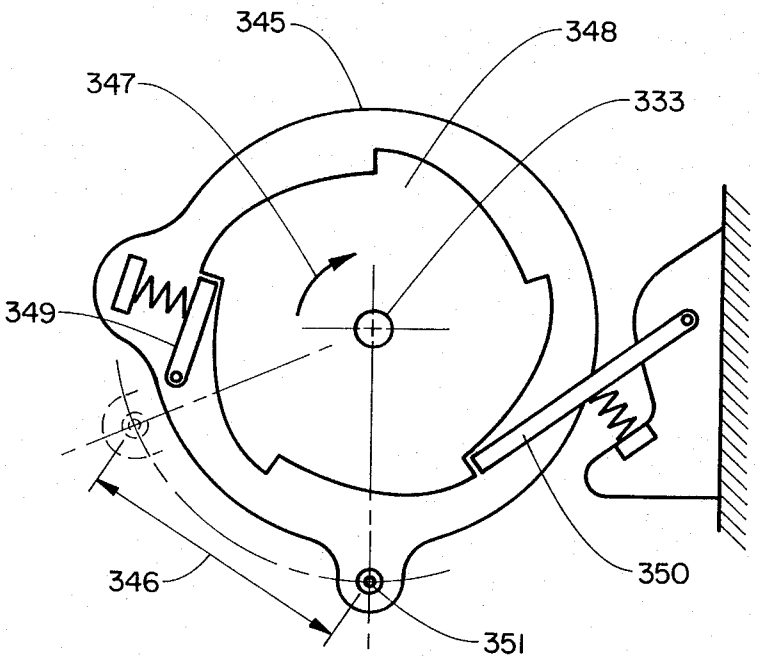
Figure 24:
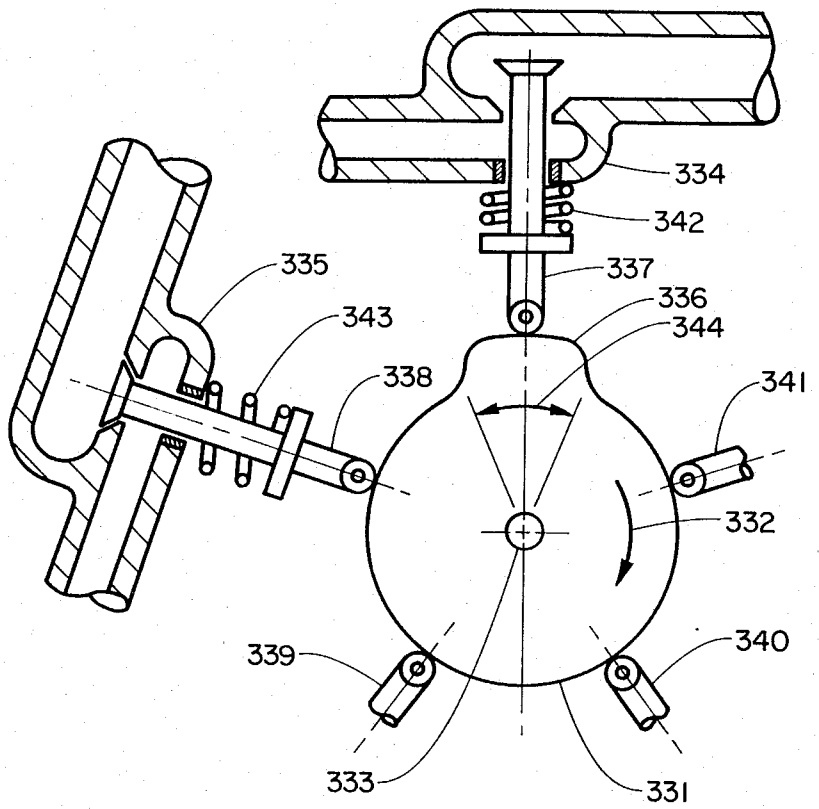
Figure 26:
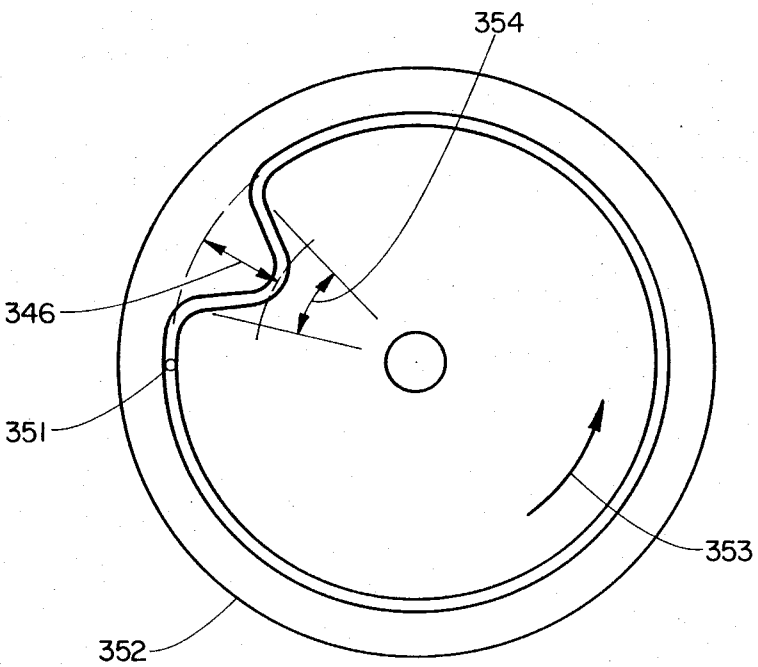

A mechanical drive means for opening and closing the changeable gas flow connections of a cyclic char gasifier is shown schematically in FIGS. 24 and 25 which can be used with the exhaust divider valve drive means of FIGS. 21, 22, and 23 via the drive coordinator shown in FIG. 26.

Figure 27:
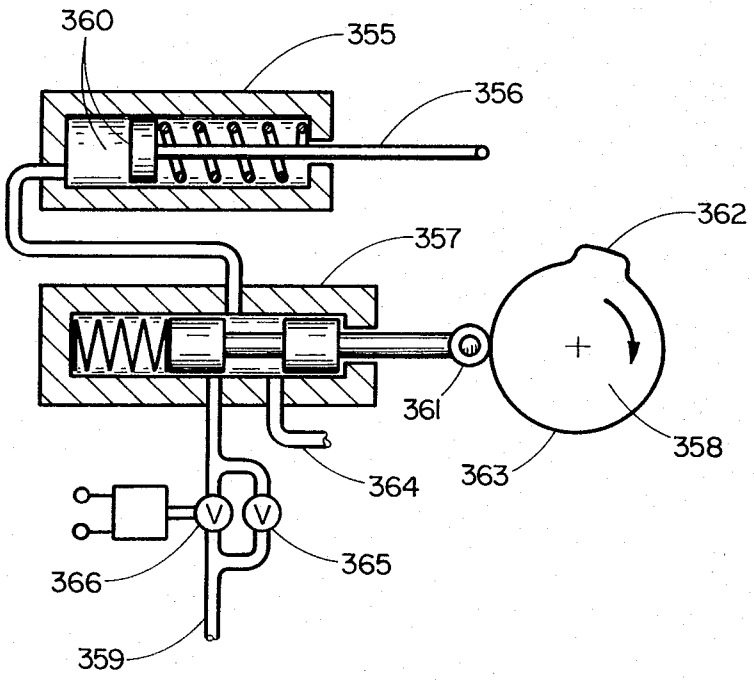

A primarily mechanical drive and and control means for refuel and coke removal of pressure vessel containers is shown partially in FIG. 27.

Figure 28:
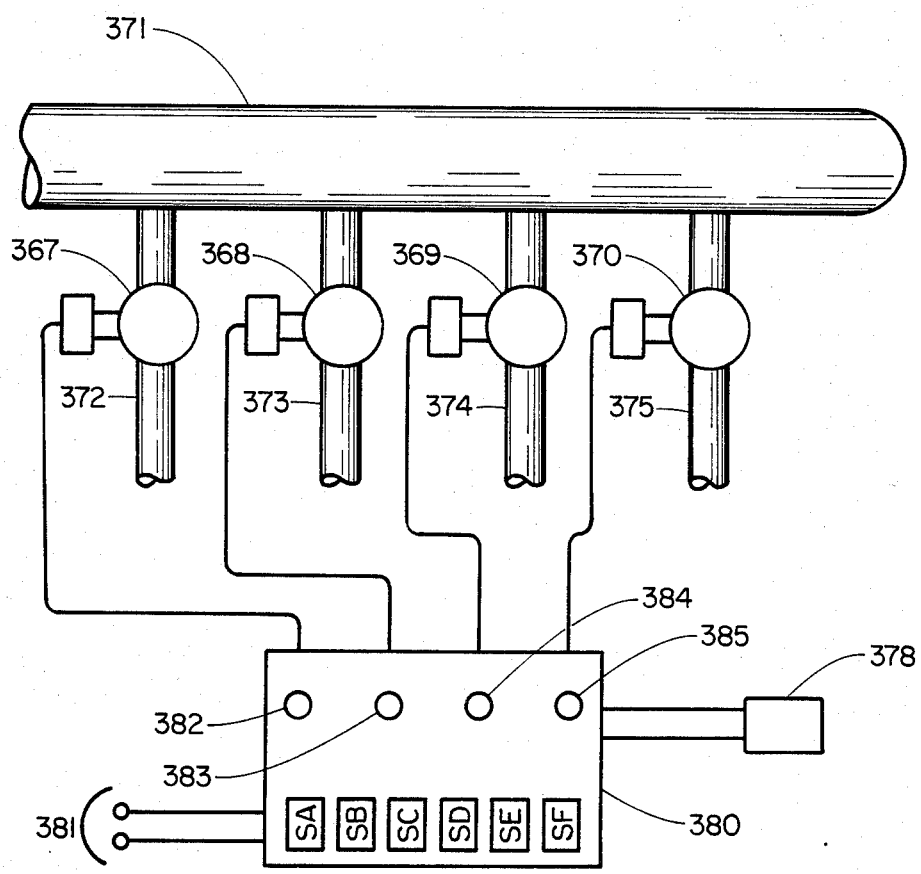
Figure 29:
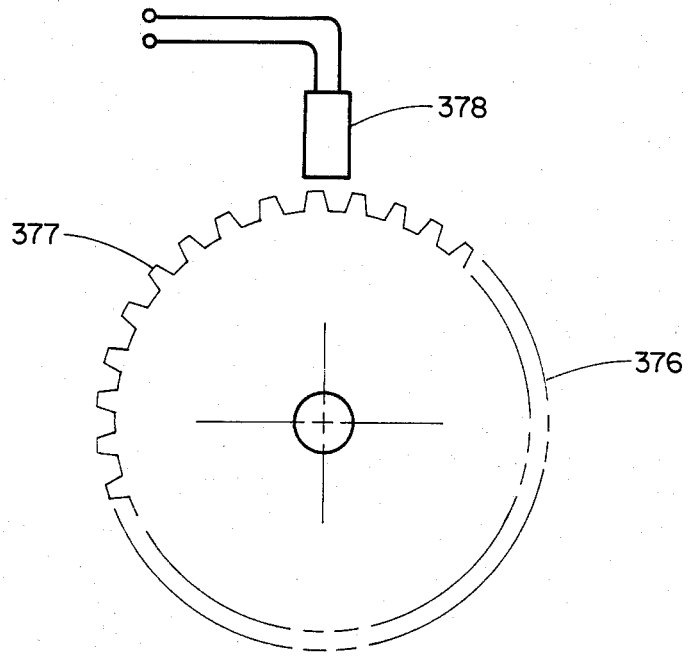

A ganged type of exhaust divider valve with electrical and electronic drive and control means is shown schematically in FIGS. 28 and 29.

DESCRIPTION OF THE PREFERRED EMBODIMENTS

The processes of this invention utilize the same basic processes and apparatus as are described in my earlier referenced application A, except that an exhaust divider valve is herein connected between at least one expander lowest pressure stage discharge and two or more product gas collector pipes and driven through a sequence of connections so that two or more differing and separated product reacted gases can be produced from each single separate expander so equipped. To achieve this same result of two differing and separated product reacted gases, my earlier referenced application A required the use of two separate expanders whereas the invention described herein can achieve this same beneficial result with but a single separate expander. In this way, the invention described herein can be utilized to reduce the cost of a cyclic char gasifier plant and this is a principal beneficial object of this invention.

The following portions of my earlier cross referenced application A and the drawings are incorporated herein by reference thereto:

(1) Page 9 line 18 through page 24 line 3:

This material describes the basic char fuel gasification processes which are utilized also in the invention described herein.

(2) Page 24 line 5 through page 76 line 27:

This material describes the apparatus of a cyclic char gasifier plant which is utilized also in the invention described herein, except that herein we add on at least one exhaust divider valve element and a drive means and control means therefor. Each such exhaust divider valve is connected between the discharge of but one separate expander and at least two separate product gas collector pipes.

The terminology used herein and in these claims is the same as the terminology used in the material incorporated by reference to my earlier cross referenced application A, except that the means for opening and closing the changeable gas flow connections between containers and compressor stage delivery ends and expander stage inlet ends is herein and in these claims referred to as a drive means for opening and closing.

Each exhaust divider valve comprises an inlet port, at least two discharge ports, and a means for connecting the inlet port to the discharge ports, one discharge port at a time. Various types of exhaust divider valves can be used for the purposes of this invention such as rotary selector valves, multiple ganged valves, sliding selector valves, etc., and some examples are described hereinafter. The inlet port of each exhaust divider valve has a fixed open gas flow connection to the discharge end of the lowest pressure stage of but one separate expander, and this one separate expander is thusly connected to but one exhaust divider valve inlet. Each discharge port of each exhaust divider valve has a fixed open gas flow connection to but one product gas collector pipe and this one product gas collector pipe is thusly connected to but one exhaust divider valve discharge port. Where more than one separate expander is used and some separate expanders do not have exhaust divider valves connected to their lowest pressure stage discharge, then each of these latter separate expanders has a fixed open gas flow connection to but one product gas collector pipe, and this one product gas collector pipe is thusly connected to but one separate expander and not to any exhaust divider valve discharge ports. Hence, the total number of product gas collector pipes is to be equal to the total number of separate expanders plus the total number of discharge ports on all exhaust divider valves minus the total number of exhaust divider valves. In this way, each product gas collector pipe receives product reacted gas either from one discharge port of one exhaust divider valve or from the lowest pressure stage discharge of one separate expander.

Each exhaust divider valve connecting means for connecting the inlet port to the discharge ports, one discharge port at a time, is driven through an exhaust divider sequence of such connectings by a drive means for driving this connecting means. This drive means drives the connecting means so that each discharge port is connected to the inlet port once during each sequence, and so that only one discharge port is connected to the inlet port at a time, and so that the inlet port always has one discharge port thusly connected. When one such exhaust divider sequence of connectings is completed, it is then repeated by the drive means with the order of connecting into discharge ports remaining the same for these continuously repeated sequences of connectings. Each discharge port of each exhaust divider valve is in this way opened for a sub time period to the inlet port of its exhaust divider valve and the sum of these sub time periods for all of the discharge ports of any one exhaust divider valve is the total time period for completion of one exhaust divider sequence of connectings. This time period for one sequence shall equal the time period between changes of gas flow connectings, tcc, between containers and compressor stage delivery ends and expander stage inlet ends as is described hereinbelow. Within each single exhaust divider sequence, the several sub time periods need not be equal for the several discharge ports.

The control means for controlling the drive means for opening and closing the changeable gas flow connections also functions to control the drive means for driving the connecting means of the exhaust divider valves so that each exhaust divider sequence starts concurrently with the starting of each time period between changes of gas flow connectings (tcc) and ends concurrently with the ending of that same time period. In this way, each container delivers product gas into each product gas collector pipe while changing pressure between essentially the same values during expansion and hence the product gas delivered into each collector pipe remains essentially unchanged.

Where more than one exhaust divider valve is used, their separate drive means are to be controlled by the control means to thusly start and end their separate exhaust divider valve sequences concurrently. However, as between two such separate exhaust divider valve sequences, the sub time intervals within one sequence between changes of connectings between inlet ports and discharge ports can differ as between different exhaust divider valves. Additionally, two such separate exhaust divider valves need not have the same number of discharge ports and hence need not have the same number of sub time intervals. However, where the number of discharge ports and the sequence of lengths of sub time periods are the same for all exhaust divider valves of a cyclic char gasifier plant, a single drive means can be used for the concurrent driving of all the connecting means of all the exhaust divider valves. Various kinds of drive means can be used for the driving of the connecting means of the exhaust divider valve such as mechanical drive, electrical drive pneumatic drive, etc. as well as combination drives. Some examples of suitable drive means are described hereinafter. Various kinds of control means can be used for the controlling of the drive means for opening and closing the changeable gas flow connectings and the drive means for driving the connecting means similar to the examples in the referenced application A. Some examples of suitable control means are described hereinafter.

Usually it is only where the product reacted gas, leaving the containers during expansion, changes as the pressure drops, and hence as a time period progresses, that an exhaust divider valve can be useful. The change can be a change of composition, as from a rich gas to a lean gas, such as can be created by use of steam stratification or use of oxygen gas stratification as is described in the material incorporated by reference from referenced application A. Alternatively, or additionally, the change can be a change of gas temperature leaving the expander when chemical reaction occurs inside the pores of the char fuel, as is also described in the material incorporated by reference from referenced application A. Even in devolatilization char gasifiers a change of composition can occur since the reactant gas first to enter the char pores during compression remains therein longer than that reactant gas last to enter the char pores. The exhaust divider valve can thus separate into separate product gas collector pipes a rich gas from a lean gas, or a hotter gas from a cooler gas, even when but a single separate expander is used and this is a principal intended beneficial object of this invention. The exhaust divider valve accomplishes this separation by directing the product gases flowing at different times, and hence leaving the container at different pressures, into different product gas collector pipes.

A separate expander fitted with an exhaust divider valve can be of a single stage or of several stages, but the single stage case will yield more complete separation of the product gases and is preferred for this reason. In an expander with, for example, two stages, the first product gases leaving the first stage result from container pressure drop from the highest to the intermediate pressure. These first product gases then flow through the second stage concurrently with the second product gases, resulting from container pressure drop from the intermediate pressure to the lowest exhaust pressure, and are inevitably mixed with these second product gases. Because of this mixing in the later stage of a multistage expander the completeness of product gas separation which an exhaust divider valve can accomplish is necessarily reduced. By use of a single stage expander, which expands each container through the same pressure range as the multistage expander, more complete product gas separation can be achieved by the exhaust divider valve since each product gas portion from each container pressure drop interval passes separately through the expander and then into the exhaust divider valve to be separately directed into its separate product gas collector pipe. By thus keeping each product gas portion separated from other portions, the mixing of these portions inevitable in the multistage expander is avoided, and more complete separation results. A disadvantage of thusly using single stage expanders is the consequent increase of the work output fluctuation occurring at each change of the changeable gas flow connections. However, these work output fluctuations can be essentially fully eliminated by use of a torque leveller scheme as described in my U.S. Pat. No. 4,433,547.

One example cyclic char gasifier plant with an exhaust divider valve is shown schematically in FIG. 18 and comprises: a single stage compressor, 70, with compressor drive means, 71; two containers for char fuel, 1, 72; a non-work single stage expander, 76; changeable gas flow connections, 74, 75, 77, 78 between the containers, 1, 72 and the discharge of the compressor, 70, and the inlet of the expander, 76. The cyclic char gasifier plant of FIG. 18 additionally comprises: one exhaust divider valve, 270, with one inlet port, 271, and four discharge ports, 272, 273, 274, 275; a drive means, 276, for driving the means for connecting, 277, the inlet port, 271, to the discharge ports, 272, 273, 274, 275; a control means, 278, responsive to an expander inlet pressure sensor, 279, and operative upon the drive means, 276; four product gas collector pipes, 280, 281, 282, 283, each with a separate fixed open gas flow connection to but one discharge port of the exhaust divider valve, 270. The containers, 1, 72, can be pressure vessel containers or underground geologic containers.

The cyclic char gasifier of FIG. 18 operates in the same manner as the cyclic char gasifier of FIG. 2 of the cross referenced application A as incorporated herein by reference and the elements thereof are similarly numbered. As a result, product reacted gas flows to the expander, 76, inlet alternately from the two containers, 1, 72, and the expander inlet pressure at the sensor, 279, cycles between the maximum cycle pressure, PM, and the minimum cycle pressure, PO, during each time interval, tcc, between changes of changeable gas flow connectings. The expanded product reacted gas flows via the expander discharge end, 79, to the inlet port, 271, of the exhaust divider valve, 270, and is directed from the inlet port, 271, into the discharge ports, 272, 273, 274, 275, one discharge port at a time and in that order, by the connecting means, 277, which is periodically moved in the direction, 284, by the drive means, 276. In this way, the expanded product reacted gas is directed into the four separate product collector pipes, 280, 281, 282, 283, one collector pipe at a time and in that order, for each full revolution of the connecting means, 277. Hence, an exhaust divider sequence of connectings is thusly carried out with each full revolution of the connecting means, 277, wherein each discharge port, 272, 273, 274, 275, and hence each product gas collector pipe, 280, 281, 282, 283, respectively, is connected to the inlet port, 271, once and only one discharge port is connected at a time. This exhaust divider sequence of connectings is repeated in the same order with each full revolution of the connecting means, 277.

So that the product reacted gas delivered into any one collector pipe shall always come from the same range of pressure drop of each container, and hence will be of essentially the same composition or temperature, the driving of the connecting means, 277, is to be coordinated with the pressure drop occurring in each container during expansion. This coordination can be accomplished by the control means, 278, responsive to the expander inlet pressure sensor, 279, and hence to container pressure during expansion, and operative upon the drive means, 276, for driving the connecting means, 277, of the exhaust divider valve, 270. At the start of a time interval between changes of gas flow connectings, tcc, expander inlet pressure is maximum at PM and discharge port, 272, and connected product gas collector pipe, 280, is connected to the inlet port, 271, by the connecting means, 277. During the first sub time interval, ts1, of each tcc time interval expander inlet pressure at the sensor, 279, decreases to the first change pressure, pci, at which pressure the controller, 278, operates the drive means, 276, to rotate the connecting means, 277, on in the direction, 284, until the discharge port, 273, and connected product gas collector pipe, 281, are connected to the inlet port, 271, by the connecting means, 277. During a second sub time interval, ts2, of each tcc time interval expander inlet pressure at the sensor, 279, decreases to the second change pressure, pc2, at which pressure the controller, 278, operates the drive means, 276, to rotate the connecting means, 277, on again in the direction, 284, until the discharge port, 274, and connected product gas collector pipe, 282, are connected to the inlet port, 271, by the connecting means, 277. In similar fashion, the discharge port, 275, is connected after a third sub time interval, ts3, and then the starting discharge port, 272, is again connected after the fourth and final sub time interval, ts4, of this exhaust divider sequence of connectings. This exhaust divider sequence of connectings is then repeated in the same order during the next following and all succeeding tcc time intervals between changes of gas flow connectings. As each such exhaust divider sequence is completed, the changeable gas flow connections, 74, 75, 77, 78, are to be changed to start the next tcc time interval and the controller, 278, can act via the connection, 285, upon the drive means for opening and closing these changeable gas flow connections to assure that each exhaust divider sequence starts at the start of one tcc time interval and ends at the end of that same one tcc time interval. The drive means for opening and closing these changeable gas flow connections is not shown in FIG. 18 but can be any of such means as are described in the material incorporated by reference from referenced application A. The duration of each tcc time interval thus equals the sum of all the sub time intervals, ts1, ts2, ts3, ts4, which make up the exhaust divider sequence. In this way, each product gas collector pipe receives product gas from only one range of pressure drop of the containers, and each product gas so collected is thus of essentially constant composition. Since the four separate product gas collector pipes, 280, 281, 282, 283, receive product gas from four different ranges of pressure drop of the containers, these thusly separated product gases can differ in composition. Hence, the FIG. 18 form of cyclic char gasifier can produce several separated and differing product gases from a single separate expander, 76, and this is a principal beneficial object of this invention. A rotary exhaust divider valve is shown in FIG. 18 but other types of divider valves can alternatively be used and examples of these will be described hereinafter.

Exhaust divider valves can also be used in cyclic char gasifier plants with more than one separate expander and with multistage expanders as is shown in the example plant of FIG. 19. The compressor, containers, expanders, changeable gas flow connections, etc. and their operation are essentially similar to that for the plant of FIGS. 3 and 4 of the referenced application A. The FIG. 19 cyclic char gasifier plant differs therefrom in having two separate expanders, a two-stage expander, 25, 26, and a single-stage expander, 27, and in having an exhaust divider valve, 286, whose inlet is connected to the lowest pressure stage discharge end, 287, of the two-stage expander, 25, 26. A ganged exhaust divider valve, 286, is shown in FIG. 19, comprising four separate valves, 288, 289, 290, 291, whose inlets, 292, are common and connect with a fixed open gas flow connection, 293, to the lowest pressure stage discharge end, 287, of the two-stage expander, 25, 26. The four discharge ports of the four ganged valves, 288, 289, 290, 291, each connect separately to the four separate product reacted gas collector pipes, 294, 295, 296, 297. A control means, 298, responsive to a pressure sensor, 299, sensing inlet pressure to expander, 26, and hence container pressure in the container connected thereto, is operative upon valve drive means, 300, 301, 302, 303, so that only one but always one of the valves, 288, 289, 290, 291, is open at any one time, each valve is opened once during each exhaust divider sequence, each exhaust divider sequence starts and ends concurrently with the start and end of each single time interval between changes of gas flow connectings via the coordinating connection, 303, to the drive means for opening and closing the gas flow connections. Hence, the FIG. 19 example cyclic char gasifier operates in the same manner as the FIG. 18 example cyclic char gasifier plant to separate the product reacted gas leaving the discharge of the two-stage expander, 25, 26, into four separated and differing product gases in the four separate product gas collector pipes, 294, 295, 296, 297.

A. Details of various elements:

One particular example of an exhaust divider valve is shown in cross section in FIG. 20 of a rotary type, comprising a connecting means, 304, rotating sealably inside a stationary housing, 305, fitted with discharge ports, 306, 307, 308, 309. The connecting means, 304, connects via its inlet port, 310, always to the expander discharge and via its connecting means, 304, to the discharge ports, 306, 307, 308, 309, one port at a time in an exhaust divider sequence of connectings. The connecting means, 304, can be thusly moved through the exhaust divider sequence of connectings by various kinds of drive means and control means of which one particular example drive means is shown in FIG. 21, 22, and 23. The ratchet wheel, 311, of FIG. 21 is connected to and drives the connecting means element, 304, directly and is itself rotated by the moving pawl, 312, of the oscillating member, 313, and prevented from back rotating by the fixed pawl, 314. The oscillating member, 313, is rotated back and forth through an arc of ninety degrees, and through the distance, 317, about the centerline of rotation, 315, of the ratchet wheel, 311, by the bar, 316. A mechanical scheme for moving the bar, 316, back and forth in this manner is shown schematically in FIGS. 22 and 23. A slotted cam disc, 318, is rotated in the direction, 319, by the electric motor, 320, via the gear box, 321. The slot, 322, of the cam disc, 318, engages a captured pin, 323, on the bar, 316, so that the pin, 323, and hence the bar, 316, are moved through the distance, 317, whenever the action arc portion, 324, of the cam disc, 318, passes the pin, 323. Thus, the sub time interval between changes of exhaust divider valve discharge port connectings, ts, equals the time interval for the cam disc, 318, to complete one revolution about its centerline of rotation, 325. Where the drive motor, 320, is a constant speed motor these sub time intervals, ts, will be constant and equal for this FIG. 21, 22, 23, drive means. Alternatively, a variable speed electric motor, 320, can be energized from a power source, 326, via the motor speed setter, 327, so that the speed of the motor, 320, and hence the disc cam, 318, can be adjusted and in this way the sub time intervals of the exhaust divider sequence can be adjusted. This adjustment of ts can be done by hand, as via the speed setter knob, 328, or automatically. If automatic adjustment of sub time intervals of the exhaust divider sequence is to be used, a controller, 329, responsive to a sensor, 330, and acting upon the motor speed setter, 328, can be used in various ways. For example, the sensor, 330, can sense maximum pressure reached during compression and decrease speed of motor, 320, when this maximum pressure is below a set value and increase speed of motor, 320, when this maximum pressure is above a set value. Since adjustment of the sub time intervals, ts, is also adjustment of the time interval between changes of gas flow connectings, tcc, the controller, 329, thus adjusts the duration of compression. By thus adjusting the duration of compression, the sensor, 330, and controller, 329, can function to hold maximum compression pressure between set limits.

An example mechanical drive means for opening and closing the changeable gas flow connections between containers and compressors and expanders, and suitable for use with the drive means for driving the exhaust divider connecting means as shown in FIGS. 20, 21, 22, and 23, is shown schematically in FIGS. 24 and 25 and comprises the following:

1. A single lobe cam, 331, is rotated in the direction, 332, by the cam drive shaft, 333, and opens the changeable gas flow connections valves, 334, 335, whenever the cam raised section, 336, passes under the valve cam followers, 337, 338, 339, 340, 341, and these valves are closed by the closing springs, 342, 343, whenever the cam raised section is not under the valve cam follower. The arc, 344, of the cam raised section, 336, is made sufficient that when one valve, say, 335, is closing, the next valve, 334, is concurrently opening. The cam followers are positioned equiangularly about the centerline of the drive shaft, 333, separated by 72 degrees where five containers are used and this is also about the arc of the cam raised section, 336.

2. Only two, 334, 335, of the changeable gas flow connection valves are shown in FIG. 24, but all of these valves and any refuel or coke removal drive means for all five container pressure vessels are positioned similarly around the cam, 331, with the five such valves or drive means to be opened concurrently being at the same angular position so that all are actuated simultaneously by motion of the cam raised section, 336. Hence, the cam raised section, 336, is to be rotated 72 degrees at the start of each tcc time interval between changes of gas flow connectings and is then to remain stationary until the end of that time interval and the start of the next succeeding tcc time interval.

3. A portion of the drive means for driving the shaft, 333, in the direction, 332, when tcc time interval ends and the changeable gas flow connections are to be changed is shown in FIG. 25. A rocker plate, 345, rocks back and forth through the distance, 346, and while moving in the direction, 347, rotates the shaft, 333, via the ratchet plate, 348, and the drive pawl, 349. When the rocker plate, 345, returns the motion, the ratchet plate, 348, and hence the shaft, 333, are prevented from back rotation by the stop pawl, 350. In this way, the drive shaft, 333, and hence the cam, 331, are moved intermittently through a 72 degree arc in the direction, 332, in FIG. 24.

4. Another slotted cam disc, 352, is rotated in the direction, 353, by being secured to the shaft, 315, of the ratchet wheel, 311, of the drive means for driving the connecting means of the exhaust divider valve and is thusly rotated intermittently. The arc of action, 354, of the cam slot, 355, is positioned angularly so as to pass completely the captured pin, 351, while the ratchet wheel, 311, is being rotated by motion of the oscillating member, 313, to end one exhaust divider sequence and to start the next exhaust divider sequence. The captured pin, 351, is thusly moved through the distance, 346, and being secured to the rocker plate, 345, the rocker plate is also moved through the distance, 346, once for each revolution of the cam disc, 352, and hence once for each revolution of the ratchet wheel, 311, and thus once for each exhaust divider sequence. In this way, completion of each exhaust divider sequence ends the current tcc time interval and starts the next tcc time interval. The cam disc, 352, thus functions as a control means for controlling between the drive means for driving the exhaust divider valve connecting means and the drive means for opening and closing the changeable gas flow connections so that each tcc time period starts concurrently with the starting of one of the exhaust divider sequences and ends concurrently with the ending of that same one exhaust divider sequence.

Where the cyclic char gasifier plant uses pressure vessel containers, a refuel mechanism will be needed and a coke removal mechanism will also usually be needed. The refuel and coke removal mechanism shown in FIGS. 7 and 8 of the referenced application A is an example of a mechanism for these purposes and can be modified as follows for more ready use with the mechanical drive means shown in FIGS. 21, 22, 23, 24, 25, 26:

a. The solenoid, DRF, and associated wiring of FIG. 7 of referenced application A are replaced with the pneumatic piston and spring actuator, 355, shown in FIG. 27, whose piston rod, 356, carries out the back and forth rotation of the valve, 147, of FIG. 7, referenced, when a refuel process (or a coke removal process) is to be carried out.

b. The actuator valve, 357, is driven by the cam, 358, so as to connect high pressure control fluid from a source, 359, to the piston face and chamber, 360, whenever the follower, 361, is on the raised cam portion, 362, and the by-pass valve, 365, is open, and to connect the piston face and chamber, 360, to atmospheric or other low pressure vent, 364, whenever the follower, 361, is on the cam base circle, 363. One actuator, 355, and one actuator valve, 358, can be used on each refuel mechanism on each container and also on each coke removal mechanism on each container.

c. The cam, 358, can be the same as the cam, 331, of FIG. 24, in which case one refuel process (or a coke removal process) will take place for some one container during each tcc time period between changes of changeable gas flow connections.

d. More commonly both refuel and coke removal are to take place less frequently than once each tcc time period and this reduced rate can be achieved by driving the cam, 358, via a reduction gear from the shaft, 333, of the cam, 331, at a speed reduced an integral ratio from the speed of the shaft, 333, and with the raised section, 362, of cam, 358, reduced proportionately in arc length and phased to act on the lifters, 361, concurrently with the actions of the raised section, 336, of the cam, 331, on the lifters, 337, 338, 339, etc. With this geared down drive for the cam, 358, separate cams can be used for refuel and for coke removal so that refuel intervals and coke removal intervals can be different. However, the refuel interval and the coke removal interval are each a fixed and integral number of tcc time intervals and cannot be adjusted except by changing the ratio of the reduction gear drive of the cam, 358, which cannot ordinarily be done while the plant is operating.

e. Adjustable refuel and coke removal intervals can alternatively be obtained by having the cam, 358, the same as the cam, 331, of FIG. 24, by closing the by-pass valve, 365, and opening and closing the solenoid interrupter valve, 366, via the controller, 151, shown in FIG. 8 of the referenced application A. With this arrangement, a refuel process (or a coke removal process) will only occur when the controller, 151, has opened the interrupted valve, 366, and the cam raised section, 362, has also lifted the follower, 361.

f. The controller, 151, can thusly control refuel interval (or coke removal interval) in various ways. For example, the inputs, 152, can be used to count the number of tcc time intervals and when these reach a set number, the solenoid valve, 366, for the appropriate container is opened and a refuel process, or a coke removal process, takes place during the next following tcc time interval. The set number of tcc time intervals in each refuel time interval (or in each coke removal time interval) can be adjusted in integral steps by adjusting the knob, 157.

g. Alternatively, where coke removal is to be controlled by ash accumulation within the container, the ash level sensors can be the input at, 152, to the controller, 151, and can function essentially as described in the referenced application A.

Other types of exhaust divider valves, drive means, and control means can be used for the purposes of this invention. For example, a ganged exhaust divider valve can be used as shown in FIG. 19. In FIGS. 28 and 29 such a ganged exhaust divider valve is shown together with an electrical and electronic drive means and control means suitable for use with the electrical drive means for driving the changeable gas flow connectings shown in FIGS. 9 and 10 of the referenced application A, and these schemes comprise the following:

1. The four solenoid and spring driven valves, 367, 368, 369, 370, have a common inlet port, 371, connected to the lowest pressure stage discharge of one separate expander, and four separate discharge ports, 372, 373, 374, 375, each connected separately to a separate product reacted gas collector pipe, as shown for example in FIG. 19.

2. The toothed counter wheel, 376, of FIG. 29 is rotated at a set speed by an electric motor and the magnetic material teeth, 377, create counting pulses in the sensor, 378.

3. The electronic controller, 380, responsive to the counts pulses of the sensor, 378, is operative upon the solenoid and spring drive means of the valves, 367, 368, 369, 370, to open only one of these valves at a time in the selected exhaust divider sequence whenever the counts pulses from the sensor reach a preset value. When all four valves, 367, 368, 369, 370, of this exhaust divider valve have been thusly opened to complete a full exhaust divider sequence, one of the switches, SA, SB, SC, SD, SE, SF, is closed and the preceding closed switch is opened and in the order, SA, SB, SC, SD, SE, SF, and this order is repeated. Necessary electric power is furnished to the electronic controller, 380, from a power source, 381.

4. The switches, SA, SB, SC, SD, SE, SF, operate the drive means for opening and closing the changeable gas flow connectings as shown in FIGS. 9 and 10 of the referenced application A except that these switches are herein operated, as described, by the controller, 380, instead of being container pressure actuated switches as shown in FIG. 9.

5. In this way, each tcc time interval between changes of gas flow connectings starts with the starting of one exhaust divider sequence and ends with the ending of that same exhaust divider sequence, and the exhaust divider sequences, and hence also the tcc time intervals, are continuously repeated whenever the plant is operating.

6. The separate sub time intervals, ts1, ts2, ts3, ts4, of the exhaust divider sequence can be made separately adjustable by adjusting the separate preset values of counts via the knobs, 382, 383, 384, 385.

7. The duration of the sub time intervals, ts1, ts2, ts3, ts4, and of the tcc time interval can be adjusted by adjusting the rotational speed of the counter wheel, 376, as by use of a variable speed electric motor. This time interval adjustment can be made in various ways as, for example, in response to maximum compression pressure in containers as already described hereinabove for FIGS. 22 and 23.

B. Plant Sizing:

A cyclic char gasifier plant of this invention can be sized in essentially the same manner as a cyclic char gasifier plant described in the referenced application A. The several change pressures, pc1, pc2, etc., for the exhaust divider valve are best determined in pilot plant experiments and preferably with exhaust divider valves installed. Each change pressure is to occur when the product reacted gas chemical composition has changed sufficiently that succeeding product gas is preferably directed into the next product gas collector pipe in the exhaust divider sequence. In principle, the changing of the exhaust divider valve connection could be made in response to the product gas composition instead of in response to container pressures and such composition sensors and suitable control means are known in the prior art.

Various particular examples of cyclic char gasifier plants of this invention have been described herein for purposes of illustration, but it is not intended thereby to limit the invention to these illustrative examples.

Having thus described my invention, what I claim is:

1. A cyclic char gasifier plant comprising:

at least one compressor means for compressing gases from a lower pressure to a higher pressure and each such compressor comprising at least one stage and each such stage comprising a supply end and a delivery end;

means for driving each of said compressors;

at least one separate expander means for expanding gas from a higher pressure to a lower pressure and each such expander comprising at least one stage and each such stage comprising an inlet end and a discharge end;

at least two separate containers for containing char fuel;

at least two product gas collector pipes;

at least one reactant gas supply source;

each such compressor whose number of stages exceeds one further comprising fixed open gas flow connections from the delivery end of each compressor stage, except one, to the supply end of one other stage of said compressor, whereby said stages of said compressor are connected in series so that the pressure of a particular gas mass, at delivery from each stage, increases as said gas mass is compressed through said series connected stages, from the supply end to the delivery end of each stage, with the first stage in said series through which a gas mass first flows being both the lowest pressure stage and also that one stage whose supply end does not have a fixed open gas flow connection from the delivery end of any other stage or said compressor, and with the last stage in said series through which a gas mass last flows being both the highest pressure stage and also that one stage whose delivery end does not have a fixed open gas flow connection to the supply end of any other stage of said compressor;

fixed open gas flow connections from the supply end of the lowest pressure stage of each of said compressors to at least one reactant gas supply source;

each such expander whose number of stages exceeds one further comprising fixed open gas flow connections from the discharge end of each expander stage, except one, to the inlet end of one other stage of said expander, whereby said stages of said expander are connected in series so that the pressure of a particular gas mass at discharge from each stage, decreases as said gas mass is expanded through said series connected stages, from the inlet end to the discharge end of each stage, with the first stage in said series through which a gas mass first flows being both the highest pressure stage and also that one stage whose inlet end does not have a fixed open gas flow connection from the discharge end of any other stage of said expander, and with the last stage in said series through which a gas mass last flows being both the lowest pressure stage and also that one stage whose discharge end does not have a fixed open gas flow connection to the inlet end of any other stage of said expander;

changeable gas flow connections, which are openable and closeable, from each of said containers to each delivery end of each stage of each of said compressors and to each inlet end of each stage of each of said expanders;

each cyclic char gasifier plant comprising a number of said containers, with changeable gas flow connections to said compressors and to said expanders, at least equal to the sum of the number of compressor stages of all compressors and the number of expander stages of all expanders;

drive means for opening and closing said changeable gas flow connections so that, each container is opened for a time period to each delivery end of each stage of each of said compressors, in a sub-sequence of time periods of open gas flow connections to compressors, said sub-sequence proceeding in time order of increasing compressor stage delivery pressure, and is opened for a time period to each inlet end of each stage of said expanders, in a sub-sequence of time periods of open gas flow connections to expanders, said sub-sequence proceeding in time order of decreasing expander stage inlet pressure, said sub-sequence of connections to said compressor being followed by said sub-sequence of connections to said expanders, and these together comprise one sequence of time periods of open gas flow connections, each of said containers is opened to only one stage during any one time period of said sequence of time periods, said sequence of time periods of open gas flow connections to said compressors and to said expanders is repeated for each of said containers by said means for opening and closing;

at least one exhaust divider valve comprising, an inlet port, at least two discharge ports and means for connecting said inlet port to said discharge ports one port at a time;

fixed open gas flow connecting means for connecting at least one expander lowest pressure stage discharge end to one exhaust divider valve inlet port so that each exhaust divider valve inlet port is connected to but one expander lowest pressure stage discharge end;

fixed open gas flow connecting means for connecting each of said exhaust divider valve discharge ports separately to one of said product gas collector pipes, and for connecting each separate expander lowest pressure stage discharge, which is not connected to an exhaust divider valve inlet port, separately to one of said product gas collector pipes, so that each product gas collector pipe not connected directly to a separate expander lowest pressure stage discharge is connected to one discharge port of one exhaust divider valve, and so that the total number of product gas collector pipes equals the total number of separate expanders plus the total number of discharge ports on all exhaust divider valves minus the total number of exhaust divider valves;

drive means for driving each of said exhaust divider valve connecting means through its exhaust divider sequence of connectings between said inlets and said discharge ports so that, only one and always one discharge port of each exhaust divider valve is connected at any one time, each discharge port is connected at least once during each exhaust divider sequence of connectings, and said exhaust divider sequence of connectings is continuously repeated whenever said plant is running;

control means for controlling said drive means for opening and closing said changeable gas flow connections and said drive means for driving said exhaust divider valves so that, said repeated sequences of time periods of open gas flow connections are a continuous series of time periods for any one containing means, and so that the delivery end of each stage of each compressor has an open gas flow connection to at least one containing means, and the inlet end of each stage of each expander has an open gas flow connection to at least one containing means, during all time periods, and so that each exhaust divider sequence of any one exhaust divider valve starts concurrently with the start and ends concurrently with the end of each single exhaust divider sequence of all other exhaust divider valves, and so that each said time period starts concurrently with the starting of one of said exhaust divider sequences of connectings and ends concurrently with the ending of said same one exhaust divider sequence of connectings, whenever said plant is operating.

2. A cyclic char gasifier plant comprising:

at least one compressor means for compressing gases from a lower pressure to a higher pressure and each such compressor comprising at least one stage and each such stage comprising a supply end and a delivery end;

means for driving each of said compressors;

at least one separate expander means for expanding gas from a higher pressure to a lower pressure and each such expander comprising at least one stage and each such stage comprising an inlet end and a discharge end;

at least two separate containers each such container comprising means for containing char fuel and any gas compressed into said char fuel, said means for containing char fuel comprising a char fuel mass contained within a geological formation;

at least two product gas collector pipes;

at least two reactant gas supply sources, at least one of which contains appreciable oxygen gas;

each such compressor whose number of stages exceeds one further comprising fixed open gas flow connections from the delivery end of each compressor stage, except one, to the supply end of one other stage of said compressor, whereby said stages of said compressor are connected in series so that the pressure of a particular gas mass, at delivery from each stage, increases as said gas mass is compressed through said series connected stages, from the supply end to the delivery end of each stage, with the first stage in said series through which a gas mass first flows being both the lowest pressure stage and also that one stage whose supply end does not have a fixed open gas flow connection from the delivery end of any other stage of said compressor, and with the last stage in said series through which a gas mass last flows being both the highest pressure stage and also that one stage whose delivery end does not have a fixed open gas flow connection to the supply end of any other stage of said compressor;

fixed open gas flow connections from the supply end of the lowest pressure stage of each of said compressors to at least one reactant gas supply source;

each such expander whose number of stages exceeds one further comprising fixed open gas flow connections from the discharge end of each expander stage, except one, to the inlet end of one other stage of said expander, whereby said stages of said expander are connected in series so that the pressure of a particular gas mass at discharge from each stage, decreases as said gas mass is expanded through said series connected stages, from the inlet end to the discharge end of each stage, with the first stage in said series through which a gas mass first flows being both the highest pressure stage and also that one stage whose inlet end does not have a fixed open gas flow connection from the discharge end of any other stage of said expander, and with the last stage in said series through which a gas mass last flows being both the lowest pressure stage and also that one stage whose discharge end does not have a fixed open gas flow connection to the inlet end of any other stage of said expander;

changeable gas flow connections, which are openable and closeable, from each of said containers to each delivery end of each stage of each of said compressors and to each inlet end of each stage of each of said expanders;

each cyclic char gasifier plant comprising a number of said containers, with changeable gas flow connections to said compressors and to said expanders, at least equal to the sum of the number of compressor stages of all compressors and the number of expander stages of all expanders;

drive means for opening and closing said changeable gas flow connections so that, each container is opened for a time period to each delivery end of each stage of each of said compressors, in a sub-sequence of time periods of open gas flow connections to compressors, said sub-sequence proceeding in time order of increasing compressor stage delivery pressure, and is opened for a time period to each inlet end of each stage of each of said expanders, said sub-sequence proceeding in time order of decreasing expander stage inlet pressure, said sub-sequence of connections to said compressor being followed by said sub-sequence of connections to said expanders, and these together comprise one sequence of time periods of open gas flow connections, each of said containers is opened to only one stage during any one time period of said sequence of time periods, said sequence of time periods of open gas flow connections to said compressors, and to said expanders is repeated for each of said containers by said means for opening and closing;

at least one char fuel heater, said char fuel heater comprising means for heating a portion of the char fuel within each of said containing means to that temperature at which said char will react rapidly with oxygen in adjacent compressed reactant gases when said cyclic char gasifier plant is being started;

a steam boiler as one of said reactant gas supply sources, said steam boiler comprising means for generating steam at a pressure at least equal to the maximum pressure reached by said containing means while being compressed with reactant gas containing appreciable oxygen gas;

fixed open gas flow connections from said steam reactant gas supply source to the discharge end of at least one compressor stage compressing reactant gas containing appreciable oxygen gas;

means for controlling the flow rate of said steam reactant through said fixed open gas flow connections so that the mass ratio of steam to oxygen flowing has the same set value at the same pressure for all containing means while being compressed with reactant gas containing appreciable oxygen gas, said set values of steam to oxygen mass ratio being greater than those values yielding expander inlet temperatures above those which the expander materials can survive functionally, and less than those values yielding char fuel temperatures below the rapid oxidation reaction temperature of said char fuel, and so that said mass ratio of steam to oxygen has at least two different set values at differing pressures, and said set values of mass ratio of steam to oxygen change to larger values as pressure increases;

at least one exhaust divider valve comprising, an inlet port, at least two discharge ports and means for connecting said inlet port to said discharge ports one port at a time;

fixed open gas flow connecting means for connecting at least one expander lowest pressure stage discharge end to one exhaust divider valve inlet port so that each exhaust divider valve inlet port is connected to but one expander lowest pressure stage discharge end;

fixed open gas flow connecting means for connecting each of said exhaust divider valve discharge ports separately to one of said product gas collector pipes, and for connecting each separate expander lowest pressure stage discharge, which is not connected to an exhaust divider valve inlet port, separately to one of said product gas collector pipes, so that each product gas collector pipe not connected directly to a separate expander lowest pressure stage discharge is connected to one discharge port of one exhaust divider valve, and so that the total number of product gas collector pipes equals the total number of separate expanders plus the total number of discharge ports on all exhaust divider valves minus the total number of exhaust divider valves;

drive means for driving each of said exhaust divider valve connecting means through an exhaust divider sequence of connectings between said inlets and said discharge ports so that, only one and always one discharge port of each exhaust divider valve is connected at any one time, each discharge port is connected at least once during each exhaust divider sequence of connectings, and said exhaust divider sequence of connectings is continuously repeated whenever said plant is running;

control means for controlling said drive means for opening and closing said changeable gas flow connections and said drive means for driving said exhaust divider valves so that, said repeated sequences of time periods of open gas flow connections are a continuous series of time periods for any one containing means, and so that the delivery end of each stage of each compressor has an open gas flow connection to at least one containing means, and the inlet end of each stage of each expander has an open gas flow connection to at least one containing means, during all time periods, and so that each exhaust divider sequence of any one exhaust divider valve starts concurrently with the start and ends concurrently with the end of each single exhaust divider sequence of all other exhaust divider valves, and so that each said time period starts concurrently with the starting of one of said exhaust divider sequences of connectings and end concurrently with the ending of said same one exhaust divider sequence of connectings, whenever said plant is operating.

3. A cyclic char gasifier plant comprising:

at least one compressor means for compressing gases from a lower pressure to a higher pressure and each such compressor comprising at least one stage and each such stage comprising a supply end and a delivery end;

means for driving each of said compressors;

at least one separate expander means for expanding gases from a higher pressure to a lower pressure and each such expander comprising at least one stage and each such stage comprising an inlet end and a discharge end;

at least two separate containers, each of said containers comprising pressure vessel means for containing char fuel and any gas compressed into said char fuel;

at least two product gas collector pipes;

at least two reactant gas supply sources, at least one of which contains appreciable oxygen gas;

each such compressor whose number of stages exceeds one further comprising fixed open gas flow connections from the delivery end of each compressor stage, except one, to the supply end of one other stage of said compressor, whereby said stages of said compressor are connected in series so that the pressure of a particular gas mass, at delivery from each stage, increases as said gas mass is compressed through said series connected stages, from the supply end to the delivery end of each stage, with the first stage in said series through which a gas mass first flows being both the lowest pressure stage and also that one stage whose supply end does not have a fixed open gas flow connection from the delivery end of any other stage of said compressor, and with the last stage in said series through which a gas mass last flows being both the highest pressure stage and also that one stage whose delivery end does not have a fixed open gas flow connection to the supply end of any other stage of said compressor;

fixed open gas flow connections from the supply end of the lowest pressure stage of each of said compressors to at least one reactant gas supply source;

each such expander whose number of stages exceeds one further comprising fixed open gas flow connections from the discharge end of each expander stage, except one, to the inlet end of one other stage of said expander, whereby said stages of said expander are connected in series so that the pressure of a particular gas mass, at discharge from each stage, decreases as said gas mass is expanded through said series connected stages, from the inlet end to the discharge end of each stage, with the first stage in said series through which a gas mass first flows being both the highest pressure stage and also that one stage whose inlet end does not have a fixed open gas flow connection from the discharge end of any other stage of said expander, and with the last stage in said series through which a gas mass last flows being both the lowest pressure stage and also that one stage whose discharge end does not have a fixed open gas flow connection to the inlet end of any other stage of said expander;

changeable gas flow connections, which are openable and closeable, from each of said containers to each delivery end of each stage of each of said compressors and to each inlet end of each stage of each of said expanders;

each cyclic char gasifier plant comprising a number of said containers, with changeable gas flow connections to said compressors and to said expanders, at least equal to the sum of the number of compressor stages of all compressors and the number of expander stage of all expanders;

at least one refuel mechanism, said refuel mechanism comprising:

means for transferring a volume of solid materials from a supply source into said containing means when said refuel transfer means is connected to said containing means;

means for connecting said refuel transfer means to said containing means for a time period for refueling and for disconnecting said refuel transfer means from said containing means at the end of said refuel time period;

means for sealing said means for connecting and disconnecting against gas leakage;

at least one coke removal mechanism, said coke removal mechanism comprising;

means for transferring a volume of solid materials out of said containing means when said coke removal transfer means is connected to said containing means;

means for connecting said coke removal transfer means to said containing means for a time period for coke removal and for disconnecting said coke removal transfer means from said containing means at the end of said coke removal time period;

means for sealing said means for connecting and disconnecting against gas leakage;

drive means for opening and closing said changeable gas flow connections so that each container is opened for a time period to each delivery end of each stage of each of said compressors, in a sub-sequence of time periods of open gas flow connections to compressors, said sub-sequence proceeding in time order of increasing compressor stage delivery pressure, and is opened for a time period to each inlet end of each stage of each of said expanders, in a sub-sequence of time periods of open gas flow connections to expanders, said sub-sequence proceeding in time order of decreasing expander stage inlet pressure, said sub-sequence of connections to said compressors being followed by said sub-sequence of connections to said expanders, and these together comprise one sequence of time periods of open gas flow connections, each of said containers is opened to only one stage during any one time period of said sequence of time periods, said sequence of time periods of open gas flow connections to said compressors and to said expanders is repeated for each of said containers by said means for opening and closing;

at least one char fuel heater, said char fuel heater comprising means for heating a portion of the char fuel within each of said containing means to that temperature at which said char will react rapidly with oxygen in adjacent compressed reactant gases when said cyclic char gasifier plant is being started;

a steam boiler as another of said reactant gas supply sources, said steam boiler comprising means for generating steam at a pressure at least equal to the maximum pressure reached by said containing means while being compressed with reactant gas containing appreciable oxygen gas;

fixed open gas flow connections from said steam reactant gas supply source to the discharge end of at least one compressor stage compressing reactant gas containing appreciable oxygen gas;

means for controlling the flow rate of said steam reactant through said fixed open gas flow connections so that the mass ratio of steam to oxygen flowing has the same set value at the same pressure for all containing means while being compressed with reactant gas containing appreciable oxygen gas, said set values of steam to oxygen mass ratio being greater than those values yielding expander inlet temperature above those which the expander materials can survive functionally, and less than those values yielding char fuel temperatures below the rapid oxidation reaction temperature of said char fuel, and so that said mass ratio of steam to oxygen has at least two different set values at differing pressures, and said set values of mass ratio of steam to oxygen change to larger values as pressure increases;

at least one exhaust divider valve comprising, an inlet port, at least two discharge ports and means for connecting said inlet port to said discharge ports one port at a time;

fixed open gas flow connecting means for connecting at least one expander lowest pressure stage discharge end to one exhaust divider valve inlet port so that each exhaust divider valve inlet port is connected to but one expander lowest pressure stage discharge end;

fixed open gas flow connecting means for connecting each of said exhaust divider valve discharge ports separately to one of said product gas collector pipes and for connecting each separate expander lowest pressure stage discharge, which is not connected to an exhaust divider valve inlet port, separately to one of said product gas collector pipes, so that each product gas collector pipe not connected directly to a separate expander lowest pressure stage discharge is connected to one discharge port of one exhaust divider valve, and so that the total number of product gas collector pipes equals the total number of separate expanders plus the total number of discharge ports on all exhaust divider valves minus the total number of exhaust divider valves;

drive means for driving each of said exhaust divider valve connecting means through an exhaust divider sequence of connectings between said inlets and said discharge ports so that, only one and always one discharge port of each exhaust divider valve is connected at any one time, each discharge port is connected at least once during each exhaust divider sequence of connectings, and said exhaust divider sequence of connectings is continuously repeated whenever said plant is running;

control means for controlling said drive means for opening and closing said changeable gas flow connections, and said means for connecting said refuel transfer means, and said means for connecting said coke removal transfer means, and said drive means for driving said exhaust divider valves so that, said repeated sequences of time periods of open gas flow connections, and any time periods available only for refueling and for coke removal, are a continuous series of time periods for any one containing means, and so that the delivery end of each stage of each compressor has an open gas flow connection to at least one containing means, and the inlet end of each stage of each expander has an open gas flow connection to at least one containing means, during all time periods, and further so that the refuel ratio is an integral number, and further so that the coke removal ratio is an integral number, and so that each exhaust divider sequence of any one exhaust divider valve starts concurrently with the start and ends concurrently with the end of each single exhaust divider sequence of all other exhaust divider valves, and so that each said time period starts concurrently with the starting of one of said exhaust divider sequences of connectings and ends concurrently with the ending of said same one exhaust divider sequence of connectings, whenever said plant is operating.

4. A cyclic char gasifier plant comprising:

at least one compressor means for compressing gases from a lower pressure to a higher pressure and each such compressor comprising at least one stage and each such stage comprising a supply end and a delivery end;

means for driving each of said compressors;

at least one separate expander means for expanding gases from a higher pressure to a lower pressure and each such expander comprising at least one stage and each such stage comprising an inlet end and a discharge end;

at least two separate containers, each of said containers comprising pressure vessel means for containing char fuel and any gas compressed into said char fuel;

at least two product gas collector pipes;

at least one reactant gas supply source;

each such compressor whose number of stages exceeds one further comprising fixed open gas flow connections from the delivery end of each compressor stage, except one, to the supply end of one other stage of said compressor, whereby said stages of said compressor are connected in series so that the pressure of a particular gas mass, at delivery from each stage, increases as said gas mass is compressed through said series connected stages, from the supply end to the delivery end of each stage, with the first stage in said series through which a gas mass first flows being both the lowest pressure stage and also that one stage whose supply end does not have a fixed open gas flow connection from the delivery end of any other stage of said compressor, and with the last stage in said series through which a gas mass last flows being both the highest pressure stage and also that one stage whose delivery end does not have a fixed open gas flow connection to the supply end of any other stage of said compressor;

fixed open gas flow connections from the supply end of the lowest pressure stage of each of said compresssors to at least one reactant gas supply source;

each such expander whose number of stages exceeds one further comprising fixed open gas flow connections from the discharge end of each expander stage, except one, to the inlet end of one other stage of said expander, whereby said stages of said expander are connected in series so that the pressure of a particular gas mass, at discharge from each stage, decreases as said gas mass is expanded through said series connected stages, from the inlet end to the discharge end of each stage, with the first stage in said series through which a gas mass first flows being both the highest pressure stage and also that one stage whose inlet end does not have a fixed open gas flow connection from the discharge end of any other stage of said expander, and with the last stage in said series through which a gas mass last flows being both the lowest pressure stage and also that one stage whose discharge end does not have a fixed open gas flow connection to the inlet end of any other stage of said expander;

changeable gas flow connections, which are openable and closeable, from each of said containers to each delivery end of each stage of each of said compressors and to each inlet end of each stage of each of said expanders;

each cyclic char gasifier plant comprising a number of said containers, with changeable gas flow connections to said compressors and to said expanders, at least equal to the sum of the number of compressor stages of all compressors and the number of expander stages of all expanders;

at least one refuel mechanism, said refuel mechanism comprising:

means for transferring a volume of solid materials from a supply source into said containing means when said refuel transfer means is connected to said containing means;

means for connecting said refuel transfer means to said containing means for a time period for refueling and for disconnecting said refuel transfer means from said containing means at the end of said refuel time period;

means for sealing said means for connecting and disconnecting against gas leakage;

at least one coke removal mechanism, said coke removal mechanism comprising;

means for transferring a volume of solid materials out of said containing means when said coke removal transfer means is connected to said containing means;

means for connecting said coke removal transfer means to said containing means for a time period for coke removal and for disconnecting said coke removal transfer means from said containing means at the end of said coke removal time period;

means for sealing said means for connecting and disconnecting against gas leakage;

drive means for opening and closing said changeable gas flow connections so that each container is opened for a time period to each delivery end of each stage of each of said compressors, in a sub-sequence of time periods of open gas flow connections to compressors, said sub-sequence proceeding in time order of increasing compressor stage delivery pressure, and is opened for a time period to each inlet end of each stage of each of said expanders, in a sub-sequence of time periods of open gas flow connections to expanders, said sub-sequence proceeding in time order of decreasing expander stage inlet pressure, said sub-sequence of connections to said compressors being followed by said sub-sequence of connections to said expanders, and these together comprise one sequence of time periods of open gas flow connections, each of said containers is opened to only one stage during any one time period of said sequence of time periods, said sequence of time periods of open gas flow connections to said compressors and to said expanders is repeated for each of said containers by said drive means for opening and closing;

at least one exhaust divider valve comprising, an inlet port, at least two discharge ports and means for connecting said inlet port to said discharge ports one port at a time;

fixed open gas flow connecting means for connecting at least one expander lowest pressure stage discharge end to one exhaust divider valve inlet port so that each exhaust divider valve inlet port is connected to but one expander lowest pressure stage discharge end;

fixed open gas flow connecting means for connecting each of said exhaust divider valve discharge ports separately to one of said product gas collector pipes, and for connecting each separate expander lowest pressure stage discharge, which is not connected to an exhaust divider valve inlet port, separately to one of said product gas collector pipes, so that each product gas collector pipe not connected directly to a separate expander lowest pressure stage discharge is connected to one discharge port of one exhaust divider valve, and so that the total number of product gas collector pipes equals the total number of separate expanders plus the total number of discharge ports on all exhaust divider valves minus the total number of exhaust divider valves;

drive means for driving each of said exhaust divider valve connecting means through an exhaust divider sequence of connectings between said inlets and said discharge ports so that, only one and always one discharge port of each exhaust divider valve is connected at any one time, each discharge port is connected at least once during each exhaust divider sequence of connectings, and said exhaust divider sequence of connectings is continuously repeated whenever said plant is running;

control means for controlling said drive means for opening and closing said changeable gas flow connections, and said means for connecting said refuel transfer means, and said means for connecting said coke removal transfer means, and said drive means for driving said exhaust divider valves so that, said repeated sequences of time periods of open gas flow connections, and any time periods available only for refueling and for coke removal, are a continuous series of time periods for any one containing means, and so that the delivery end of each stage of each compressor has an open gas flow connection to at least one containing means, and the inlet end of each stage of each expander has an open gas flow connection to at least one containing means, during all time periods, whenever said plant is operating, and further so that the refuel ratio is an integral number, and further so that the coke removal ratio is an integral number, and so that each exhaust divider sequence of any one exhaust divider valve starts concurrently with the start and ends concurrently with the end of each single exhaust divider sequence of all other exhaust divider valves, and so that each said time period starts concurrently with the starting of one of said exhaust divider sequences of connectings and ends concurrently with the ending of said same one exhaust divider sequence of connectings, whenever said plant is operating.

5. A cyclic char gasifier plant as described in claim 1, 2, 3, or 4, and further comprising:

a time period control means comprising:

means for sensing the maximum pressure reached in each container during compression connected as an input to a controller operative upon said drive means for concurrently driving all of said exhaust divider valve connecting means;

said controller comprising means for adjusting the length of the time period of each exhaust divider sequence of connectings, and hence the length of the time period between changes of changeable gas flow connectings so that as maximum compression pressure decreases below a set value, said time period increases, and as maximum compression pressure increases above a set value, said time period decreases;

means for adjusting said set values of maximum pressure reached during compression.

6. A cyclic char gasifier plant as described in claim 3 or 4, and further comprising:

a coke removal ratio control means comprising:

means for sensing the ash level within each container connected as an input to a controller operative upon said means for connecting and disconnecting said coke removal transfer means;

said controller comprising means for adjusting the coke removal ratio so that as ashes accumulate above a set level within said container, said coke removal ratio is decreased, and as ashes are removed to below a set level within said container, said coke removal ratio is increased.

7. A cyclic char gasifier plant as described in claim 2 or 3, and further comprising:

an additional reactant gas supply source comprising means for supplying an oxygen rich gas whose oxygen gas content exceeds that of air;

fixed open gas flow connections from said oxygen rich reactant gas supply source to the discharge end of at least one compressor stage compressing reactant gas containing appreciable oxygen gas;

means for controlling the supply of said oxygen rich reactant flowing through said fixed open gas flow connections so that the mass ratio of oxygen to nitrogen flowing has the same set value at the same pressure for all containing means while being compressed with reactant gases, any of which contain appreciable oxygen gas, and said mass ratio of oxygen to nitrogen has at least two different set values at differing pressures, and said set values of mass ratio of oxygen to nitrogen change to larger values as pressure increases.

8. A cyclic char gasifier plant as described in claim 1, 2, 3, or 4:

wherein at least one of said expanders is an expander engine, said expander engine comprising means for expanding gas from a higher pressure to a lower pressure so that mechanical work is done by said expanding gas upon said expander engine;

and further comprising at least one work absorber driven by said expander engines, said work absorber comprising means for absorbing the mechanical work done upon said expander engine.

9. A cyclic char gasifier plant as described in claim 2 or 3, and further comprising:

a time period control means comprising:

means for sensing the maximum pressure reached in each container during compression connected as an input to a controller operative upon said drive means for concurrently driving all of said exhaust divider valve connecting means;

said controller comprising means for adjusting the length of the time period of each exhaust divider sequence of connectings, and hence the length of the time period between changes of changeable gas flow connectings so that as maximum compression pressure decreases below a set value, said time period increases, and as maximum compression pressure increases above a set value, said time period decreases;

means for adjusting said set values of maximum pressure reached during compression;

an expander flow rate control means comprising:

means for sensing the minimum expansion pressure reached at inlet to each stage of each of said expanders, at least one such means for sensing being installed at each stage inlet of each of said expanders;

each such means for sensing being connected as an input to a means for controlling the flow rate of gas into that same stage, so that as minimum expansion pressure decreases below a set value, said flow rate decreases, and as minimum expansion pressure increases above a set value, said flow rate increase;

means for adjusting said set values of minimum pressure reached during expansion;

an expander inlet temperature control means comprising:

means for sensing the maximum temperature of the gas at inlet to said expanders connected as an input to a means for controlling the set values of steam to oxygen ratio to which said means for controlling the flow rate of steam controls, so that as maximum expander gas inlet temperature increases above a set value of temperature, said set values of steam to oxygen ratio increase, and as maximum expander gas inlet temperature decreases below a set value of temperature, said set values of steam to oxygen ratio decrease, said set values of temperature being determined by the kinds of materials used in said expanders.

10. A cyclic char gasifier plant as describe in claim 1, 2, 3, or 4, wherein each said separate expander, whose lowest pressure stage discharge end has a fixed open gas flow connection to one exhaust divider valve inlet port, is a single stage expander.

11. A cyclic char gasifier plant as described in claim 7, wherein each said separate expander, whose lowest pressure stage discharge end has a fixed open gas flow connection to one exhaust divider valve inlet port, is a single stage expander.

* * * * *